US008562406B2

(12) United States Patent
Suttle et al.

(10) Patent No.: US 8,562,406 B2
(45) Date of Patent: Oct. 22, 2013

(54) POKER SYSTEM AND METHOD FOR ALLOCATING POTS PRIOR TO AN END OF THE POKER GAME BASED ON TRUE ODDS AT THE TIME OF ALLOCATION

(71) Applicant: Tru Odds Poker, LLC, Las Vegas, NV (US)

(72) Inventors: James Suttle, North Las Vegas, NV (US); Jon Rosenberg, New Hyde Park, NY (US)

(73) Assignee: Tru Odds Poker, LLC, Las Vegas, NV (US)

( * ) Notice: Subject to any disclaimer, the term of this patent is extended or adjusted under 35 U.S.C. 154(b) by 0 days.

(21) Appl. No.: 13/766,656

(22) Filed: Feb. 13, 2013

(65) Prior Publication Data

US 2013/0157739 A1 Jun. 20, 2013

Related U.S. Application Data

(63) Continuation of application No. 12/692,773, filed on Jan. 25, 2010.

(51) Int. Cl.
*A63F 9/24* (2006.01)

(52) U.S. Cl.
USPC ..... 463/13; 273/292; 463/16; 463/25; 463/26; 463/27; 463/28

(58) Field of Classification Search
USPC ..... 273/292; 463/13, 16, 20, 25–28
See application file for complete search history.

(56) References Cited

U.S. PATENT DOCUMENTS

| | | | |
|---|---|---|---|
| 6,467,771 | B1 | 10/2002 | Dekeller |
| 2003/0070178 | A1 | 4/2003 | Boyd et al. |
| 2006/0025221 | A1 | 2/2006 | Jain et al. |
| 2006/0068870 | A1 | 3/2006 | Crawford et al. |
| 2006/0205484 | A1 | 9/2006 | Nicastro |

(Continued)

FOREIGN PATENT DOCUMENTS

EP 1895484 A1 3/2008

OTHER PUBLICATIONS

Empire Poker, Game—How to make a deal, Oct. 13, 2008, http://www.empirepoker.com/tournaments/deal_making/make_deal.html.

(Continued)

*Primary Examiner* — Dmitry Suhol
*Assistant Examiner* — Jason Yen
(74) *Attorney, Agent, or Firm* — Greenberg Traurig

(57) ABSTRACT

A method of allocating poker pots based on the true odds of winning the hand. The pot allocation is at the election of the two or more players involved in the hand after no more bets are possible (i.e., one or more players all in). Once no more bets are possible, the two or more players may elect to allocate the pot based on the true odds of each player winning the pot. The house or game operator may charge a fee in order for players to utilize the pot allocation option. In one version, players may allocate a percentage of the pot and play the hand out for the remaining percentage. In yet another version, if one player declines the pot allocation option, the house or operator may buy the player's hand and play it out. In yet another version, the pot allocation option may be offered to players multiple times during a poker game with the true odds changing based on newly displayed/dealt cards.

3 Claims, 17 Drawing Sheets

(56) References Cited

U.S. PATENT DOCUMENTS

| | | | | |
|---|---|---|---|---|
| 2006/0223605 | A1 | 10/2006 | Pullman | |
| 2006/0252480 | A1 | 11/2006 | Owen | |
| 2007/0045957 | A1 | 3/2007 | Blair | |
| 2007/0210519 | A1 * | 9/2007 | Barlev | 273/292 |
| 2008/0088087 | A1 | 4/2008 | Weitzman et al. | |
| 2008/0090632 | A1 * | 4/2008 | Kumar | 463/16 |
| 2009/0029756 | A1 | 1/2009 | Guest | |
| 2010/0210334 | A1 | 8/2010 | Crawford et al. | |

OTHER PUBLICATIONS

Empire Poker Games—FAQ, Oct. 13, 2008, http://www.empirepoker.com/tournaments/deal_making//faqs.html.

* cited by examiner

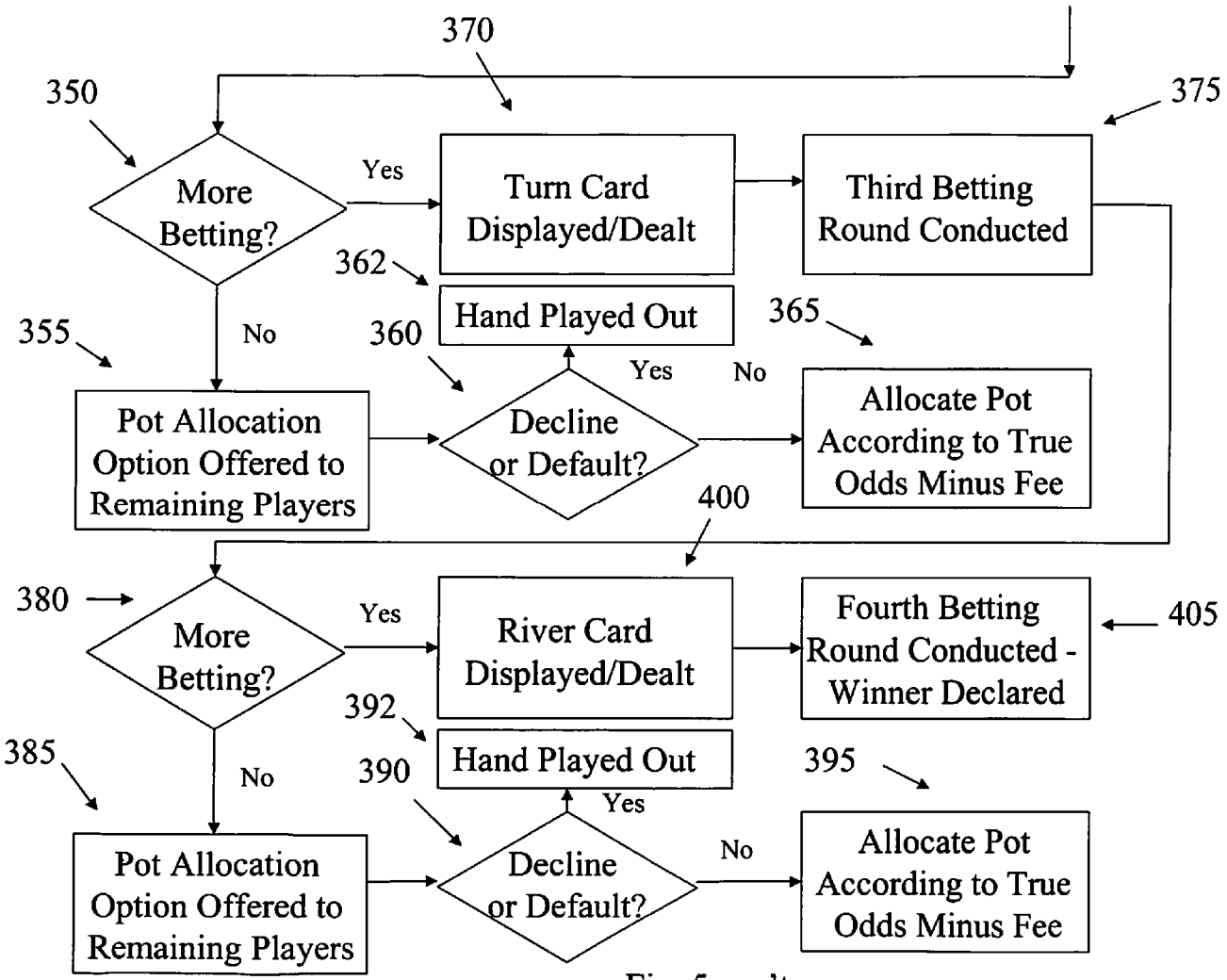
Fig. 5 con't

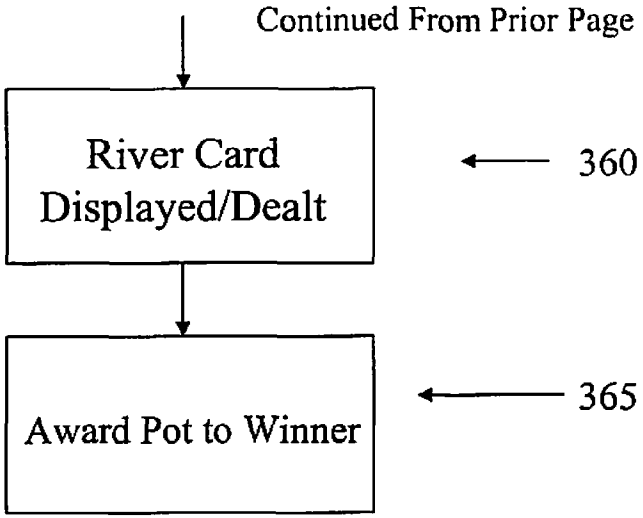
Fig. 6, con't

POKER SYSTEM AND METHOD FOR ALLOCATING POTS PRIOR TO AN END OF THE POKER GAME BASED ON TRUE ODDS AT THE TIME OF ALLOCATION

CROSS-REFERENCE TO RELATED APPLICATIONS

This application is a continuation of U.S. patent application Ser. No. 12/692,773 filed on Jan. 25, 2010 which is incorporated herein by reference for all purposes.

FIELD OF THE INVENTION

The embodiments of the present invention relate to a poker game system and method whereby players may agree to split a pot prior to the poker game ends wherein the split is based on true odds.

BACKGROUND

Poker has become a very popular game to the masses because of televised poker events and online remote access to live poker games. In other words, poker play is more mainstream and access is greatly improved. While poker has become very popular, there continue to be negative situations arising during poker games which may cause players to become discouraged with poker. One primary situation is known as the "bad beat." A poker bad beat occurs when one player is a heavy favorite to win the poker hand but loses when a second player receives one or more low probability cards to create a winning hand for the second player. For example, in Texas Hold'em a bad beat can occur when a first player holds three of a kind after the turn and a second player holds an inside straight draw. If the second player hits the card needed to complete the straight, the first player has suffered a bad beat. If a payer suffers enough bad beats, the player may become discouraged and not continue to play.

Therefore, it would be beneficial to incorporate a pot allocation method whereby players can mitigate the impact of bad beats and accept some monies when holding poor hands. Advantageously, the pot allocation system and method should be configured to allow operators to generate additional revenue.

SUMMARY

Accordingly, a first embodiment of the present invention is a method of allocating poker pots based on the true odds of winning the hand. The pot allocation is at the election of the two or more players involved in the hand after no more bets are possible (one or more players all in). Once no more bets are possible, the two or more players may elect to allocate the pot based on the true odds of each player winning the pot. In one embodiment, the house or game operator charges a fee in order for players to utilize the pot allocation option. For example, the house or operator may collect a flat fee (e.g., 0.25¢) or a percentage (e.g., 1%) of the pot when the pot allocation option is utilized by willing players. In another embodiment, players may allocate a percentage of the pot and play the hand out for the remaining percentage. In yet another embodiment, if one player declines the pot allocation option, the house or operator may buy the player's hand. For example, if a first player has a 90% chance of winning the hand and accepts the pot allocation option but the second player has a 10% chance of winning the hand and declines the pot allocation option, the house or operator can pay the first player 90% of the pot and take the player's place and play out the hand against the second player. If the house wins, the house keeps the remaining 10% of the pot but if the house loses it must pay the second player the full pot amount (i.e., the other 90% awarded to the first player).

The embodiments of the present invention are ideally suited for poker games facilitated by electronic devices (e.g., smart phone) or computer networks (e.g., the internet) which implement computer software to quickly calculate the true odds of players willing to utilize the pot allocation option and present players with a simple to use game interface to accept or decline the pot allocation option. However, live poker games held in brick and mortar casinos and card rooms may also benefit from the embodiments of the present invention as detailed below.

Other variations, embodiments and features of the present invention will become evident from the following detailed description, drawings and claims.

DETAILED DESCRIPTION

Figure 1A:
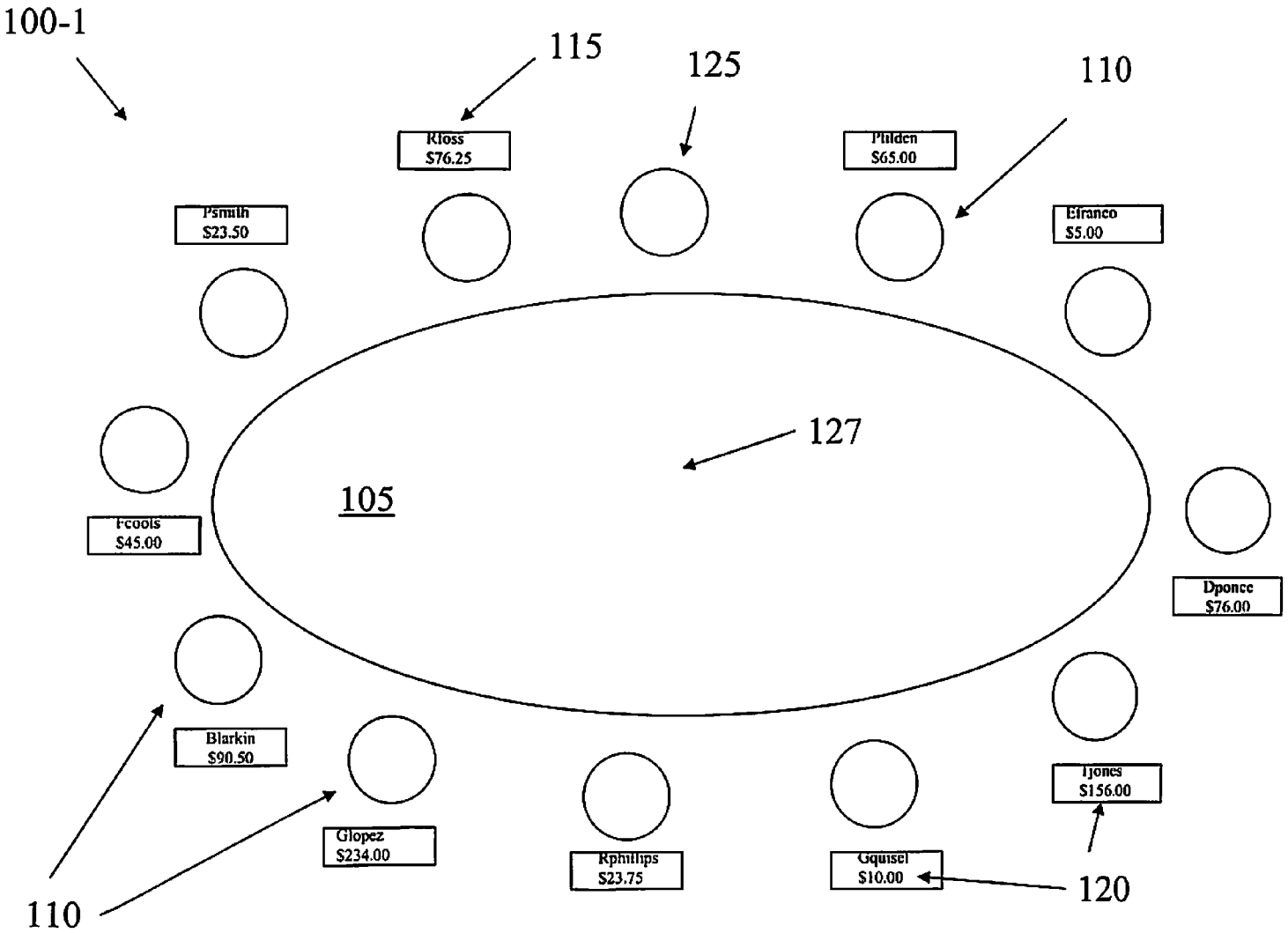
FIGS. 1*a*-1*j* illustrate exemplary screen shots showing a conventional Texas Hold'em game played out.

For the purpose of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would normally occur to one skilled in the relevant art and having possession of this disclosure, are to be considered within the scope of the invention claimed.

The embodiments of the present invention relate to a system and method for allocating poker game pots based on true odds. While the embodiments of the present invention are suitable for any and all poker games and other pot games, for the sake of brevity the detailed description below is directed to Texas Hold'em. In addition, the embodiments of the present invention may be utilized with live card games conducted in card rooms and casinos, and electronically implemented card games.

FIGS. 1*a*-1*j* illustrate various screen shots depicted on displays associated with electronic devices such as desktop and laptop computers, cellular telephones, PDAs, etc. Online websites are well-known for facilitating poker games. Such websites utilize servers to maintain poker software which allows remote players to play poker against one another via player interfaces (e.g., touch screen, mouse, keys. etc.). The websites may allow wagering or may be educational in nature. The embodiments of the present invention are ideal for implementation in an online environment.

Figure 1B:
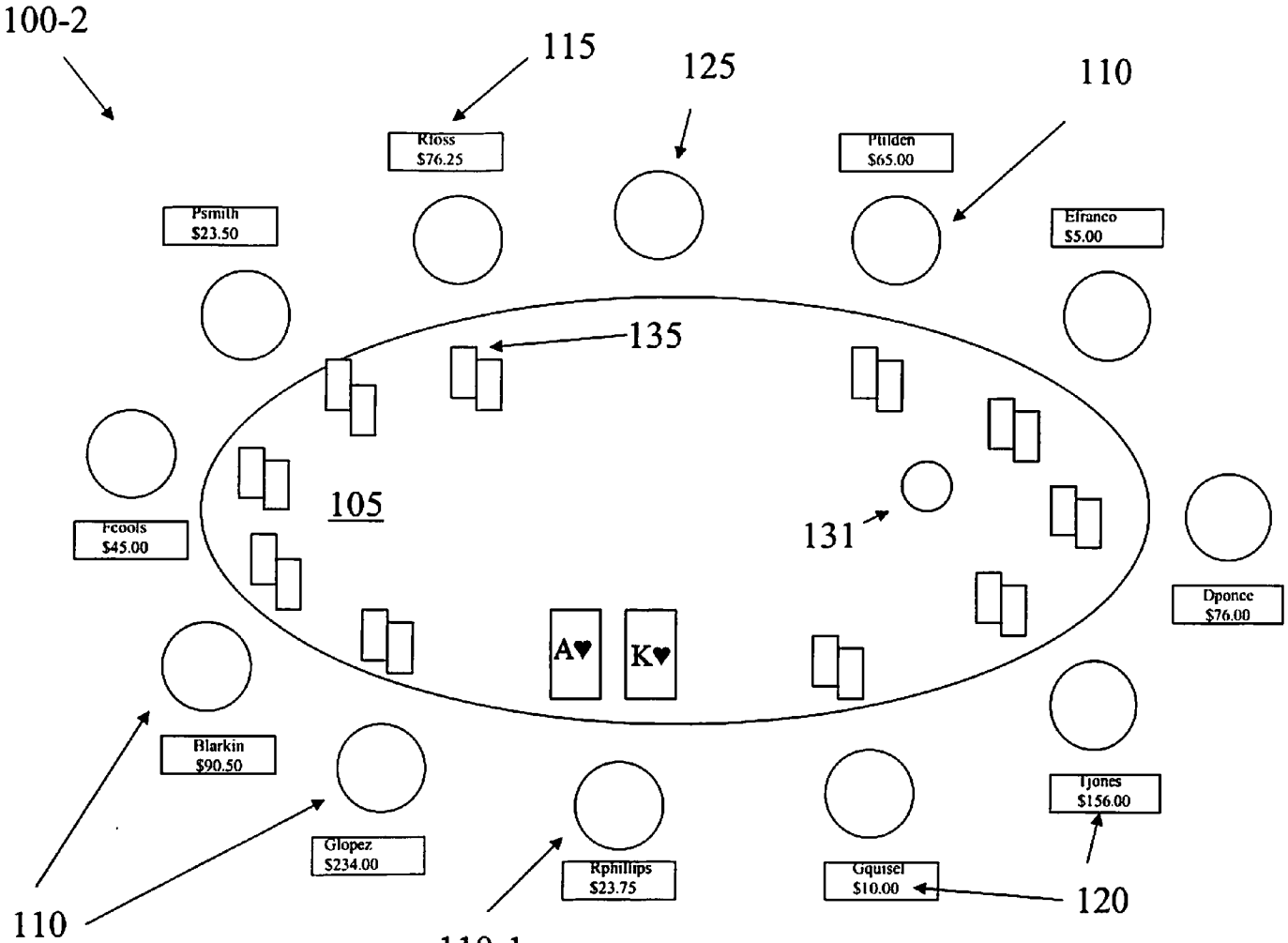
Figure 1C:
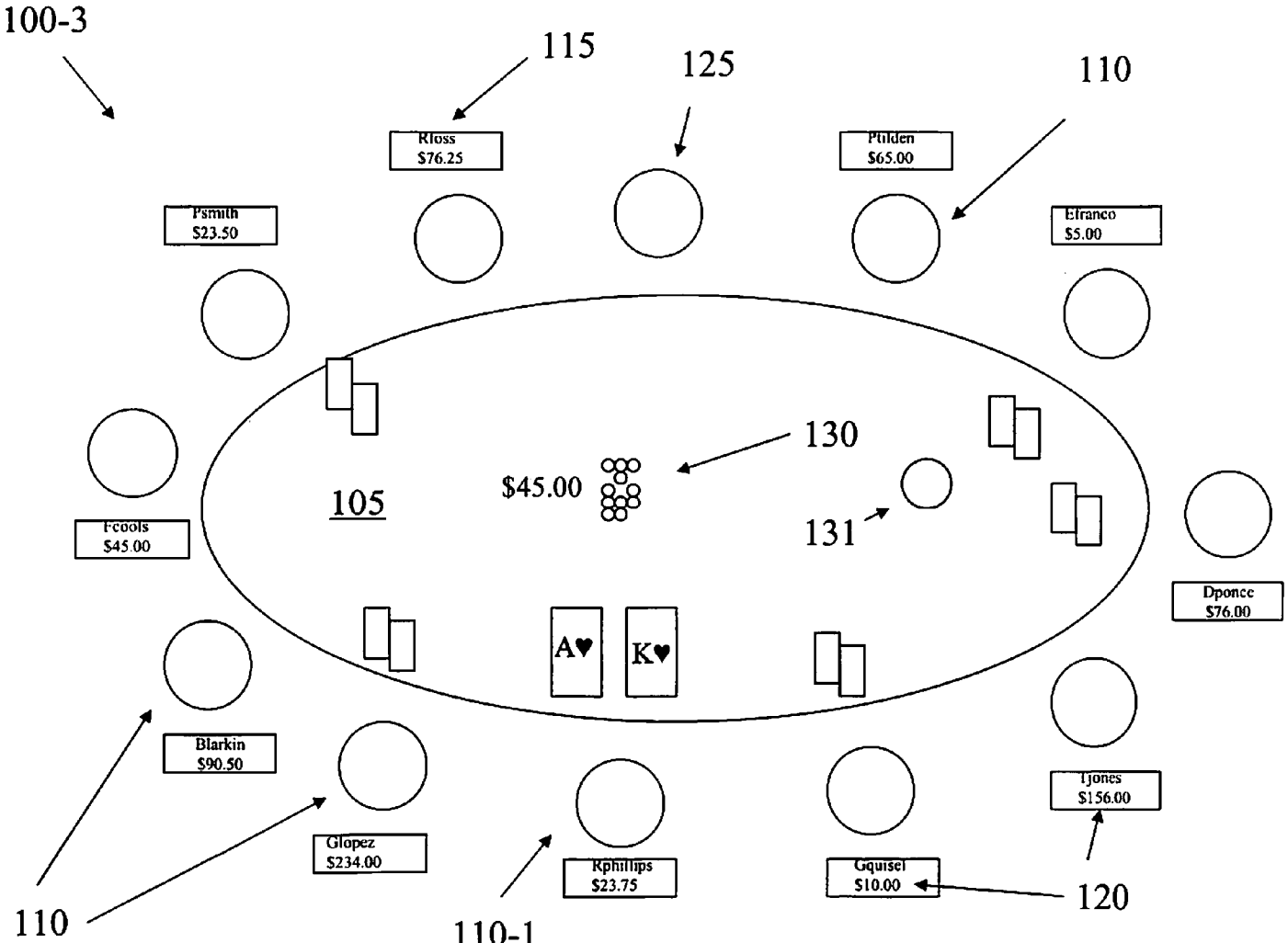
Figure 1D:
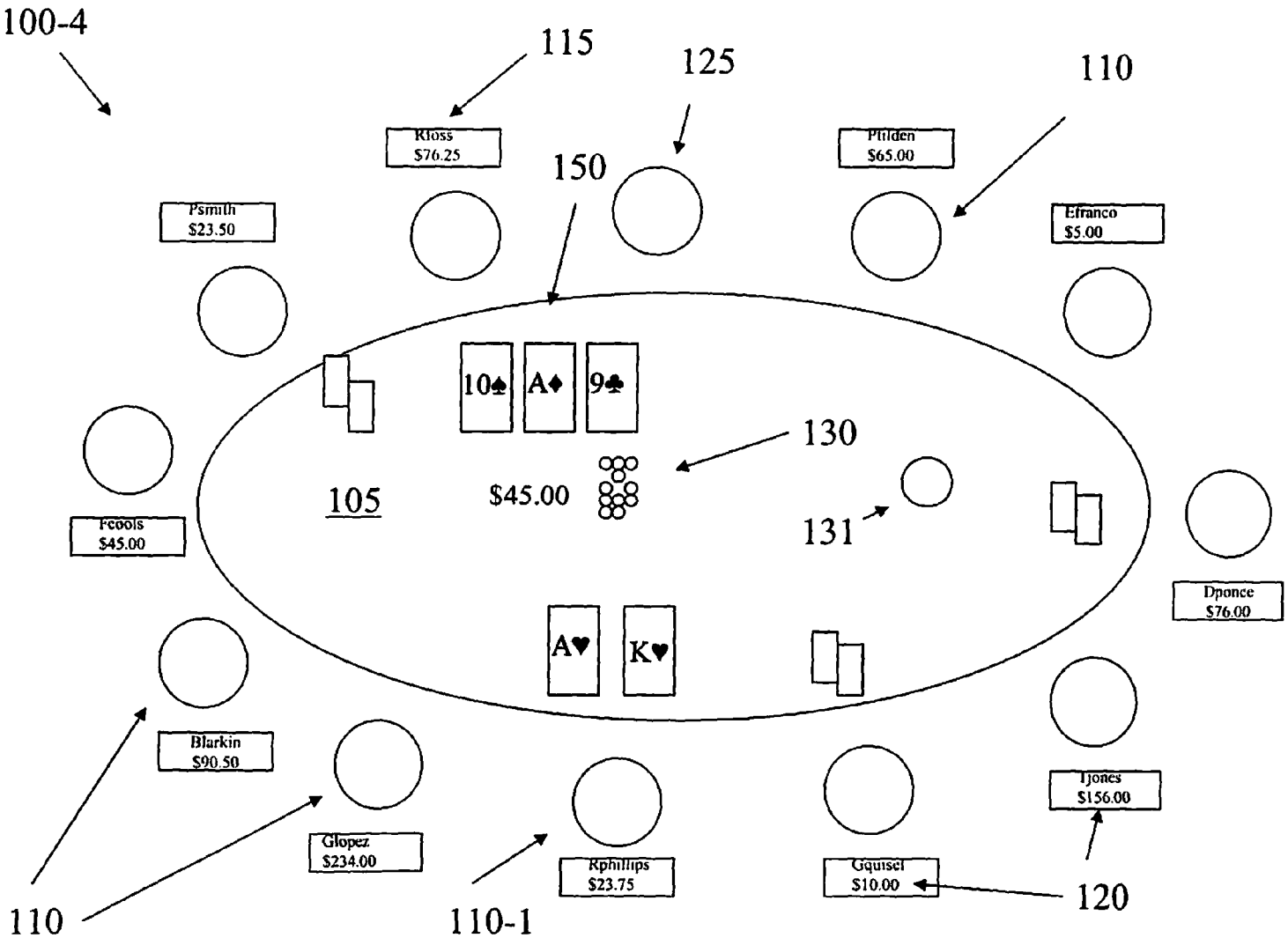
Figure 1E:
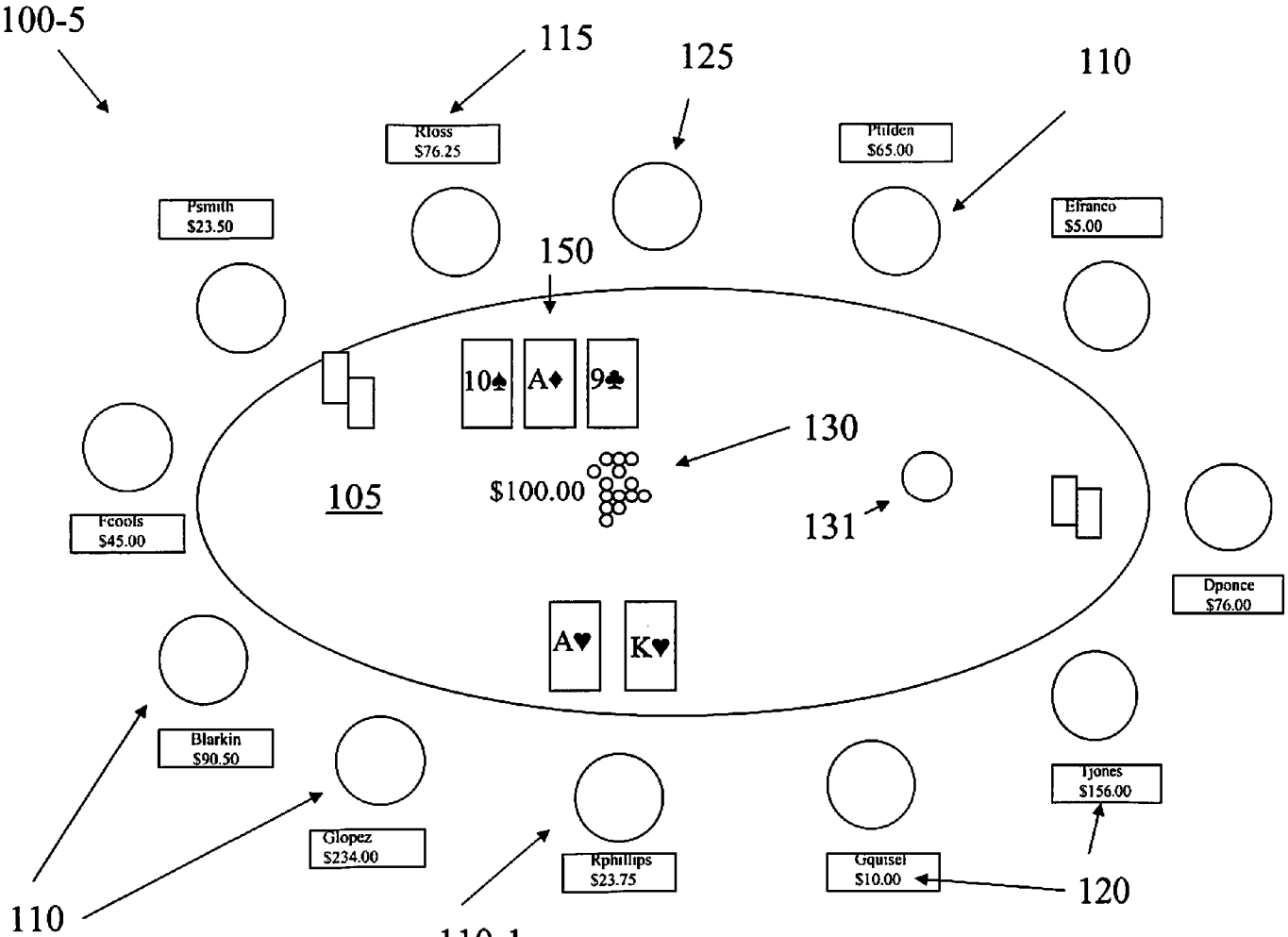
Figure 1F:
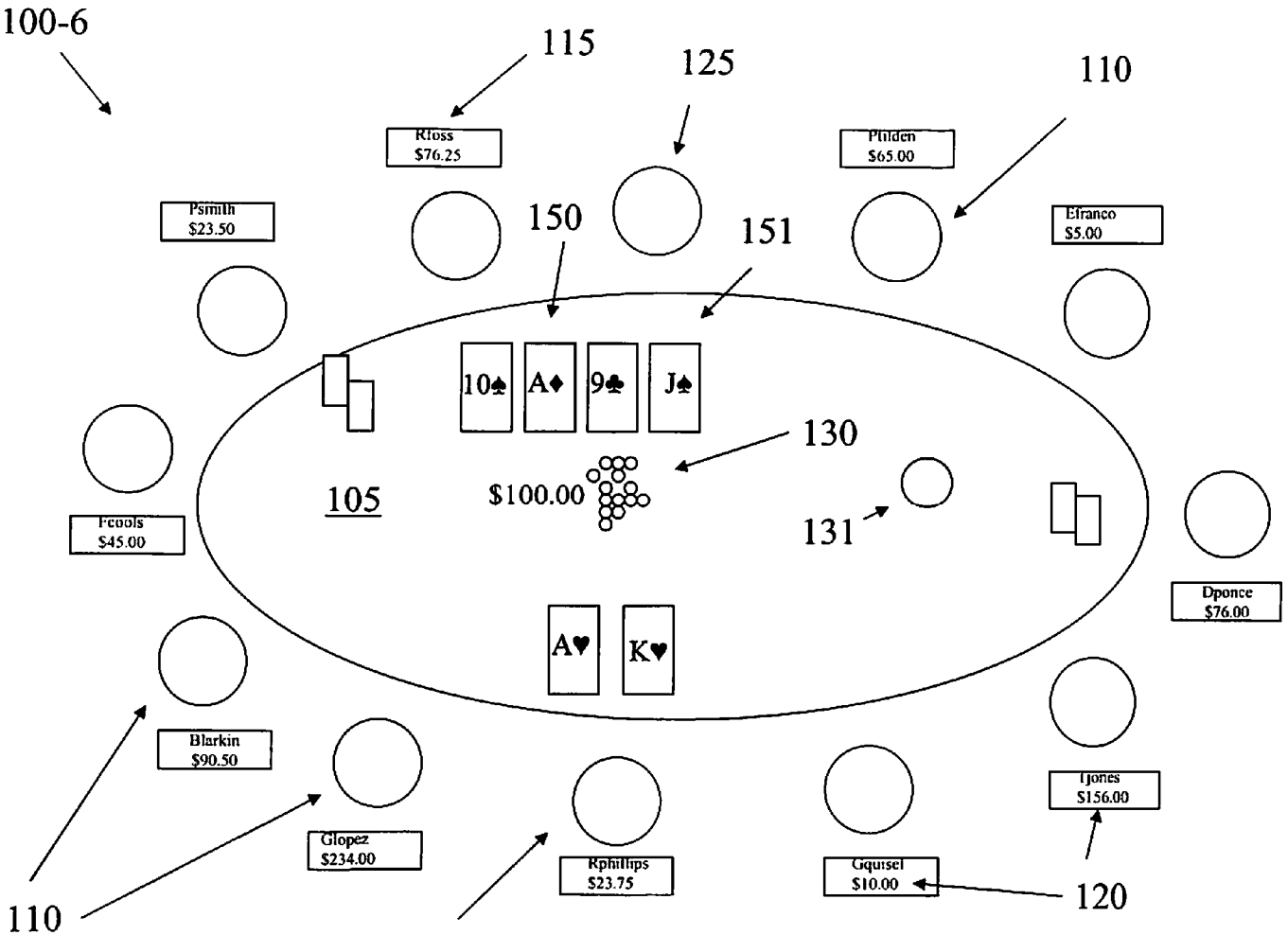
Figure 1G:
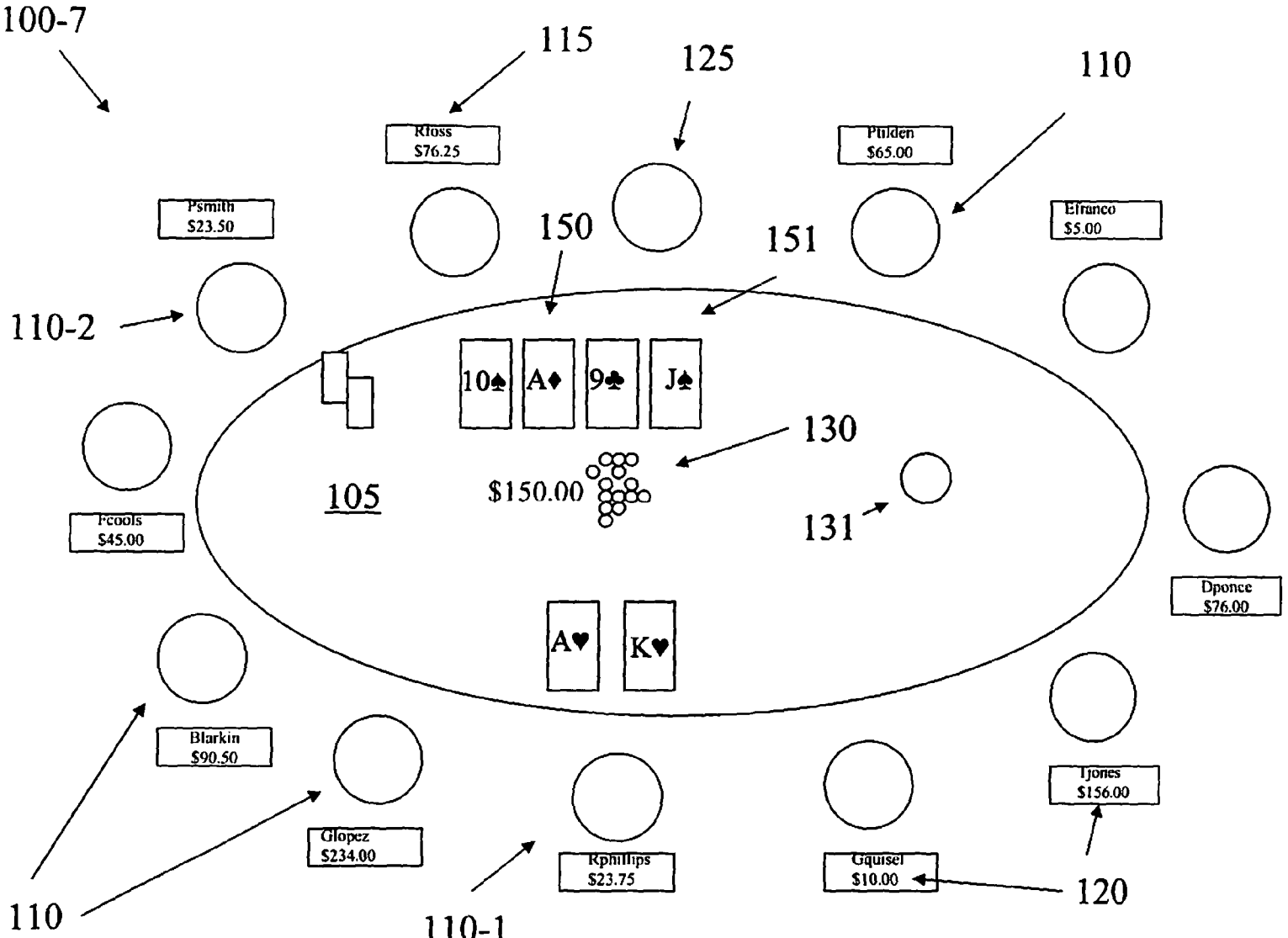
Figure 1H:
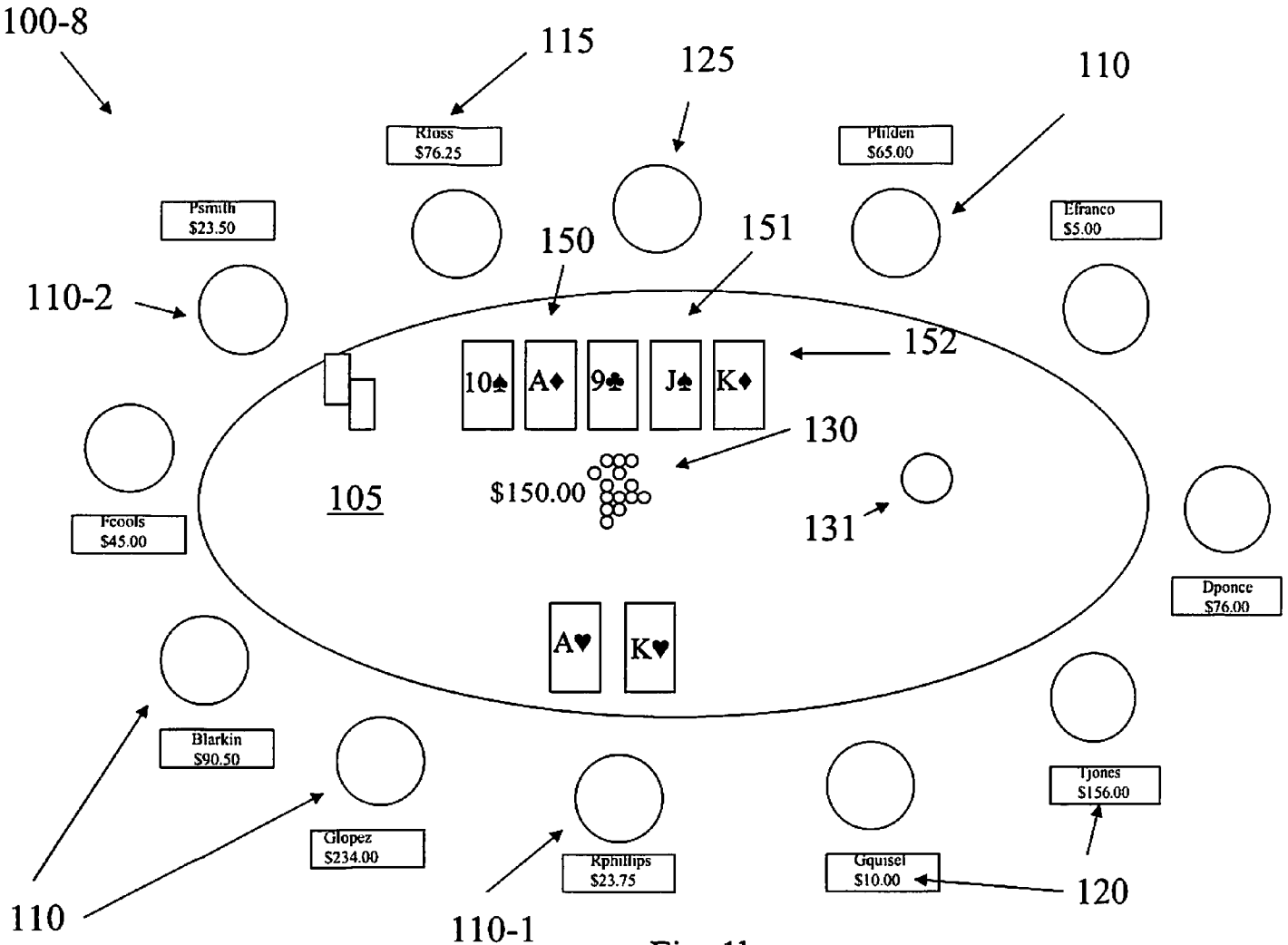
Figure 1I:
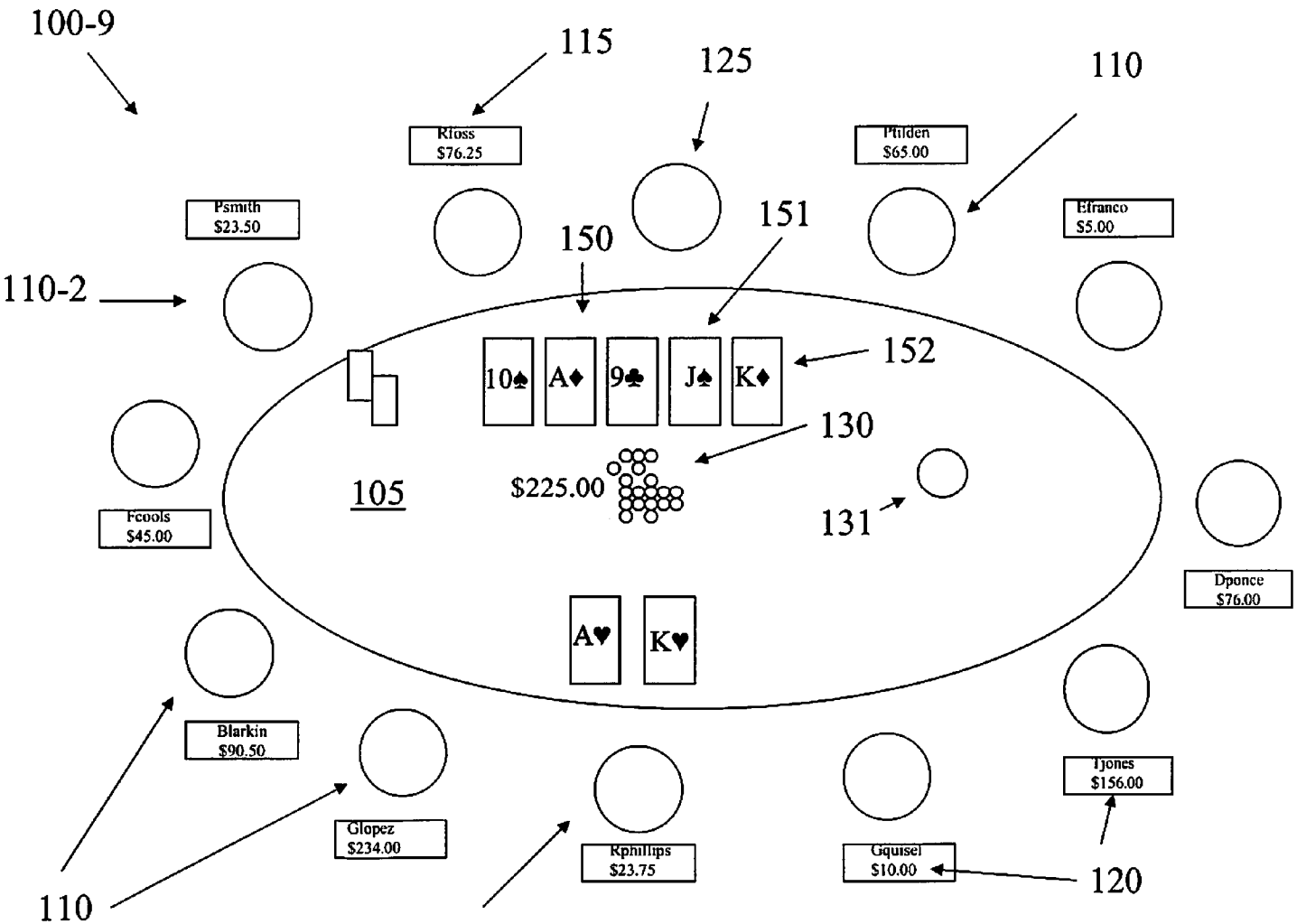
Figure 1J:
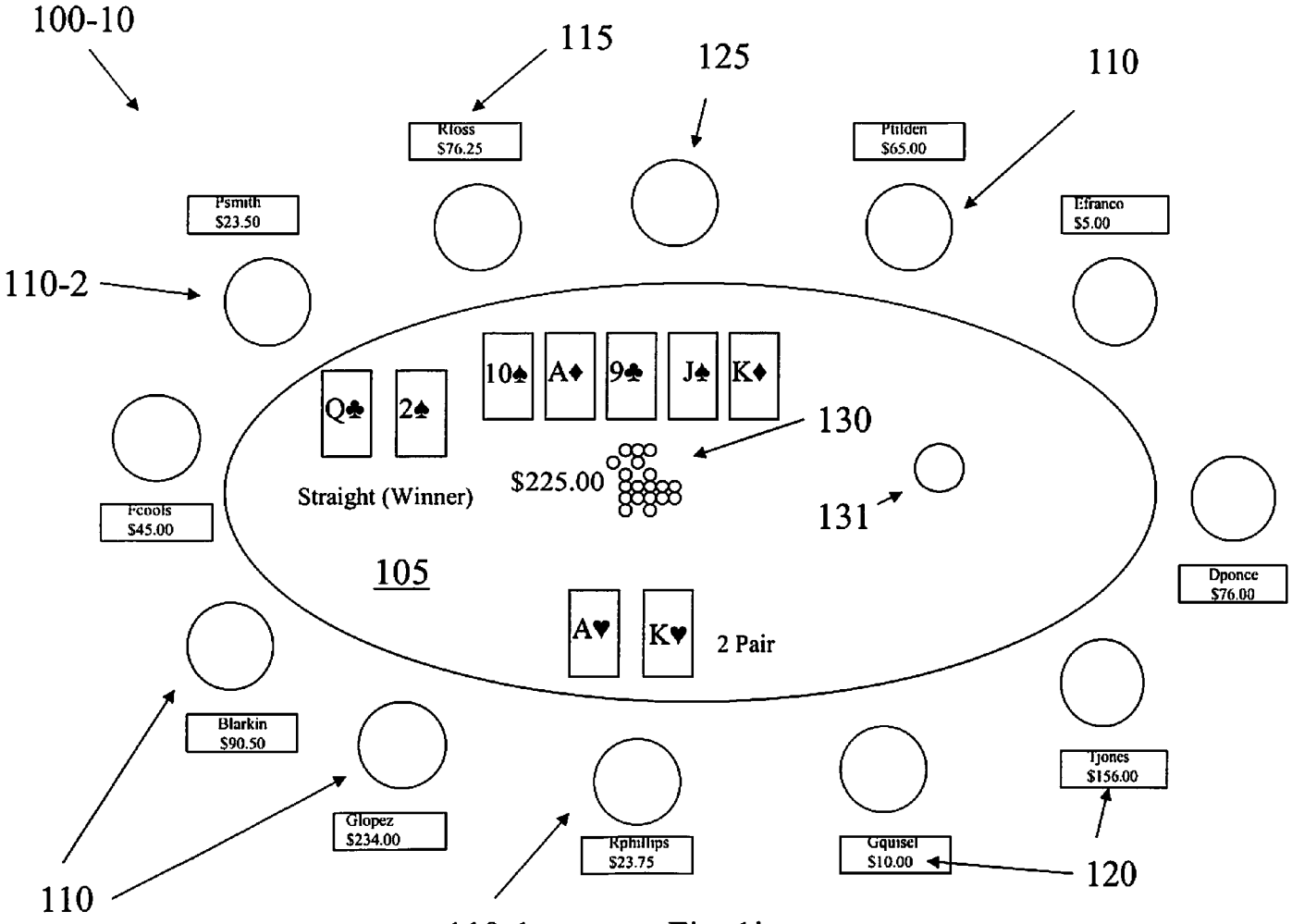

FIG. 1*a* shows a conventional online poker screen shot 100-1 including a simulated poker table 105, players 110, player screen names 115, chip counts 120, pot area 127. Those skilled in the art will recognize that other relevant information may appear on the screen shot 100-1. FIG. 1*b* shows screen shot 100-2 once each player has been dealt two hole cards 135. Each player's two hole cards 135 appear face up while all other hole cards appear face down. Once the hole cards 135 are provided to each player, a first betting round takes place as evidenced by the formation of a pot 130 and a pot total in screen shot 100-3 of FIG. 1*c*. The betting order is based on the position of the dealer button 131. Several players have folded and thus the corresponding hole cards 135 have been removed. FIG. 1*d* shows screen shot 100-4 once three flop cards 150 have been displayed. After the flop cards 150 are displayed, a second betting round takes place as shown in screen shot 100-5 of FIG. 1*e*. Again several players have folded such that the corresponding hole cards 135 have been removed. FIG. 1*f* shows screen shot 100-6 once a turn card 151 has been displayed. After the turn card 151 is displayed, a third betting round takes place as shown in screen shot 100-7 of FIG. 1*g*. After the third betting round, only two players 110-1 and 110-2 remain in the game. FIG. 1*h* shows screen shot 100-8 once a river card 153 has been displayed. After the river card 153 is displayed, a fourth and final betting round takes place as shown in screen shot 100-9 of FIG. 1*i*. Finally, screen shot 100-10 of FIG. 1*j* shows the cards of player 110-2 revealed and player 110-2 winning the pot 130 with a straight against two pair.

Figure 2:
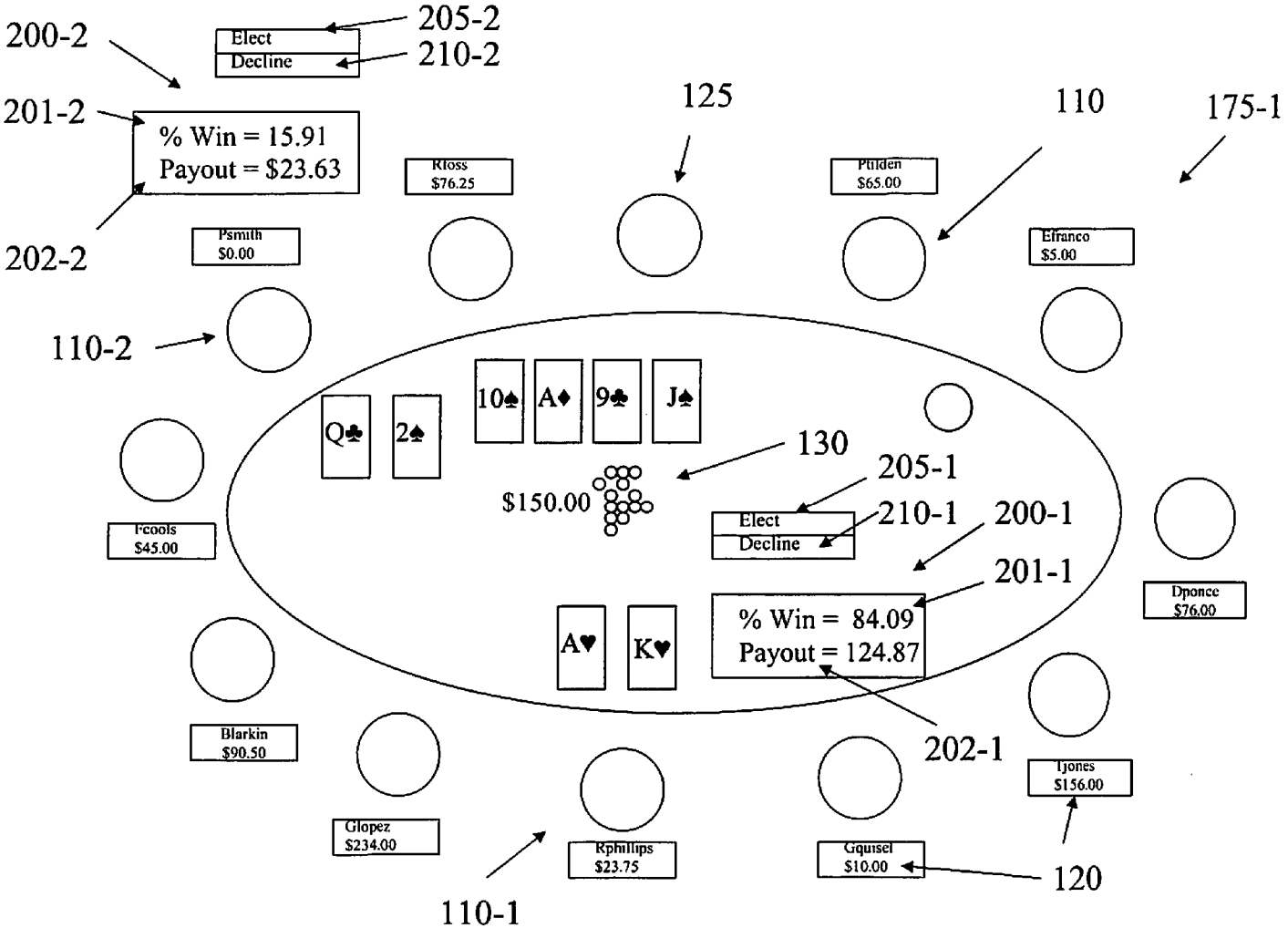
FIG. 2 illustrates an exemplary screen shot according to one embodiment of the present invention.

In a first embodiment of the present invention, two or more players involved in a hand with no more betting possible are given the opportunity to allocate the pot pursuant to the true odds. No more betting means no more than one player remaining in the hand is able to bet and all others are all in. For example, in a head-up situation at least one player is all in and with three players in the hand at least two players are all in. The embodiments of the present invention are suitable for any number of players remaining in the hand when no betting is possible. FIG. 2 shows a poker game with a heads-up situation between a first player 110-1 and second player 110-2 with the second player 110-2 all in. As shown, when such a situation arises a pot allocation window 200-1, 200-2 is presented to each player. In practice, the windows 200-1, 200-2 are only visible to each player on the player's display. The pot allocation windows 200-1, 200-2 include, in this embodiment, the option to allocate the pot according to the true odds 201-1, 201-2 associated with the respective hands and the amount 202-1,202-1 each player will receive if they accept the option. The amount 202-1, 202-2 is the allocation according to the true odds 201-1, 201-2 (i.e., the amount of the pot multiplied by the true odds) minus a percentage of the house fee paid to the house or operator for providing the pot allocation option. In a first embodiment, as shown in FIG. 2, the players pay an equal share (50%) of the house fee as removed from the pot. Alternatively, the house fee may be paid by a single player's share of the pot determined by the player with the smallest true odds, largest true odds, randomly or in any suitable manner at the time the pot allocation option is accepted by the players. The house fee may be any fee established by the house including a percentage of the pot, flat fee, advanced fee paid for an entire gaming session, etc.

Players may elect the option via box 205-1, 205-2 or decline the option via box 210-1, 210-2. Additionally or alternatively, the option may default as declined if either player does not make an election within a pre-determined amount of time (e.g., 3 seconds). Optionally a clock is associated with each pot allocation window 200 allowing players to observe how much time remains before a default occurs. If either player declines the option or the option defaults to decline for either player, the game proceeds in the normal manner with all remaining cards being displayed and the winning hand being awarded the pot. If both players decline the option or the option defaults to decline for both players, the game also proceeds in a normal manner with all remaining cards being displayed and the winner being awarded the pot. If both players accept the option, the pot is allocated as described above.

Figure 5:
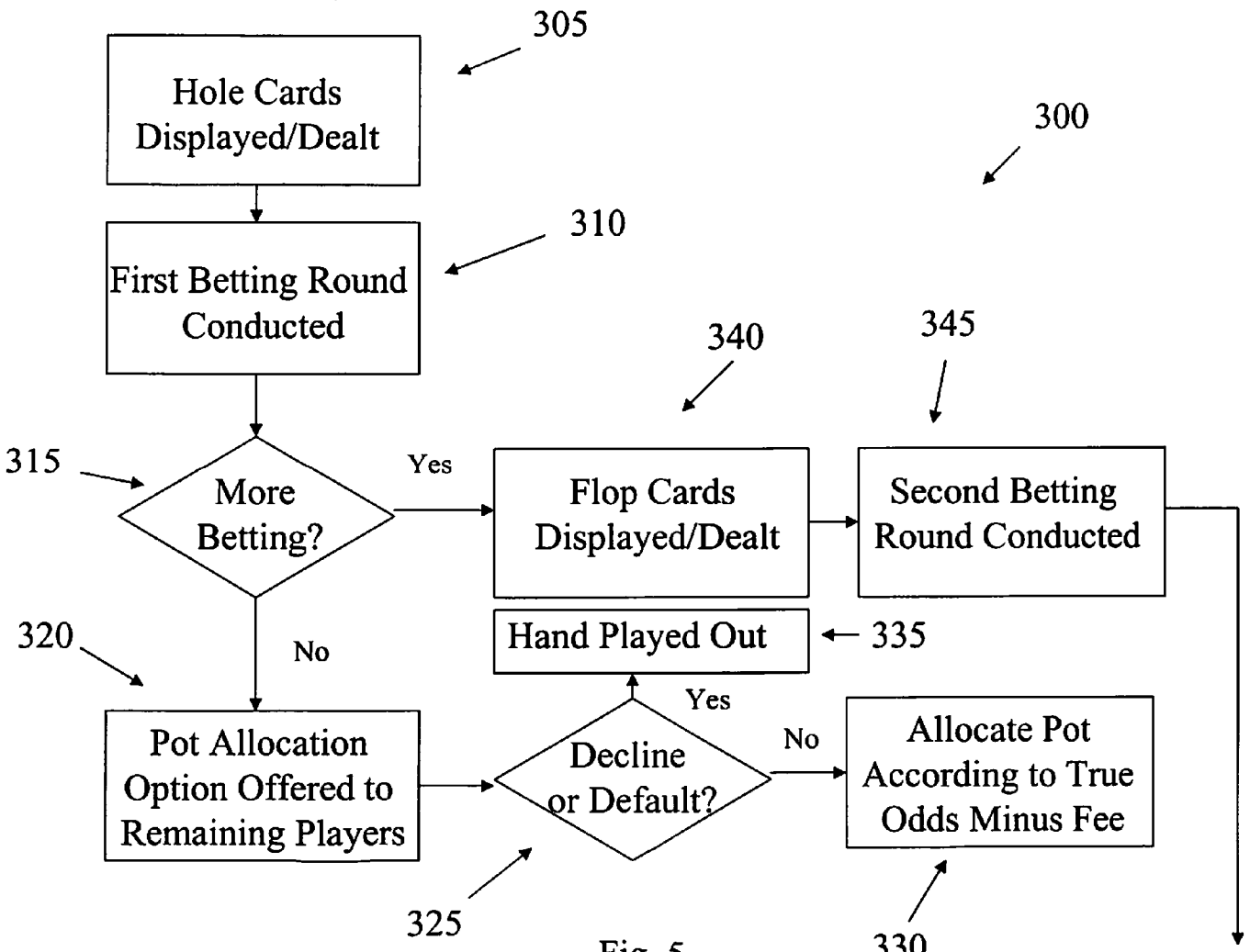
FIG. 5 illustrates a flow chart detailing an embodiment according to the embodiments of the present invention.

FIG. 5 shows a flow chart 300 detailing one Texas Hold'em method embodiment of the present invention as shown in FIG. 2. At 305, two cards are displayed/dealt to each player. At 310, a first betting round is conducted. At 315, it is determined if any betting can be conducted. If not, at 320, the pot allocation is offered to the players. If, at 325, any player declines or a default decline occurs, at 335, the hand is played out. If no player declines and no default decline occurs, at 330, the pot is allocated according to the true odds. If more betting is possible at 315, the hand advances to flop cards being displayed/dealt at 340 and a second betting rounds occurs at 345. At 350, it is determined if any betting can be conducted. If not, at 355, the pot allocation is offered to the players. If, at 360, any player declines or a default decline occurs, at 362, the hand is played out. If no player declines and no default decline occurs, at 365, the pot is allocated according to the true odds. If more betting is possible at 345, the hand advances to a turn card being displayed/dealt at 370 and a second betting rounds occurs at 375. At 380, it is determined if any betting can be conducted. If not, at 385, the pot allocation is offered to the players. If, at 390, any player declines or a default decline occurs, at 392, the hand is played out. If no player declines and no default decline occurs, at 395, the pot is allocated according to the true odds. If more betting is possible at 380, the hand advances to a river card being displayed/dealt at 400 and a fourth and final betting rounds occurs and a winner is declared at 405.

Figure 3:
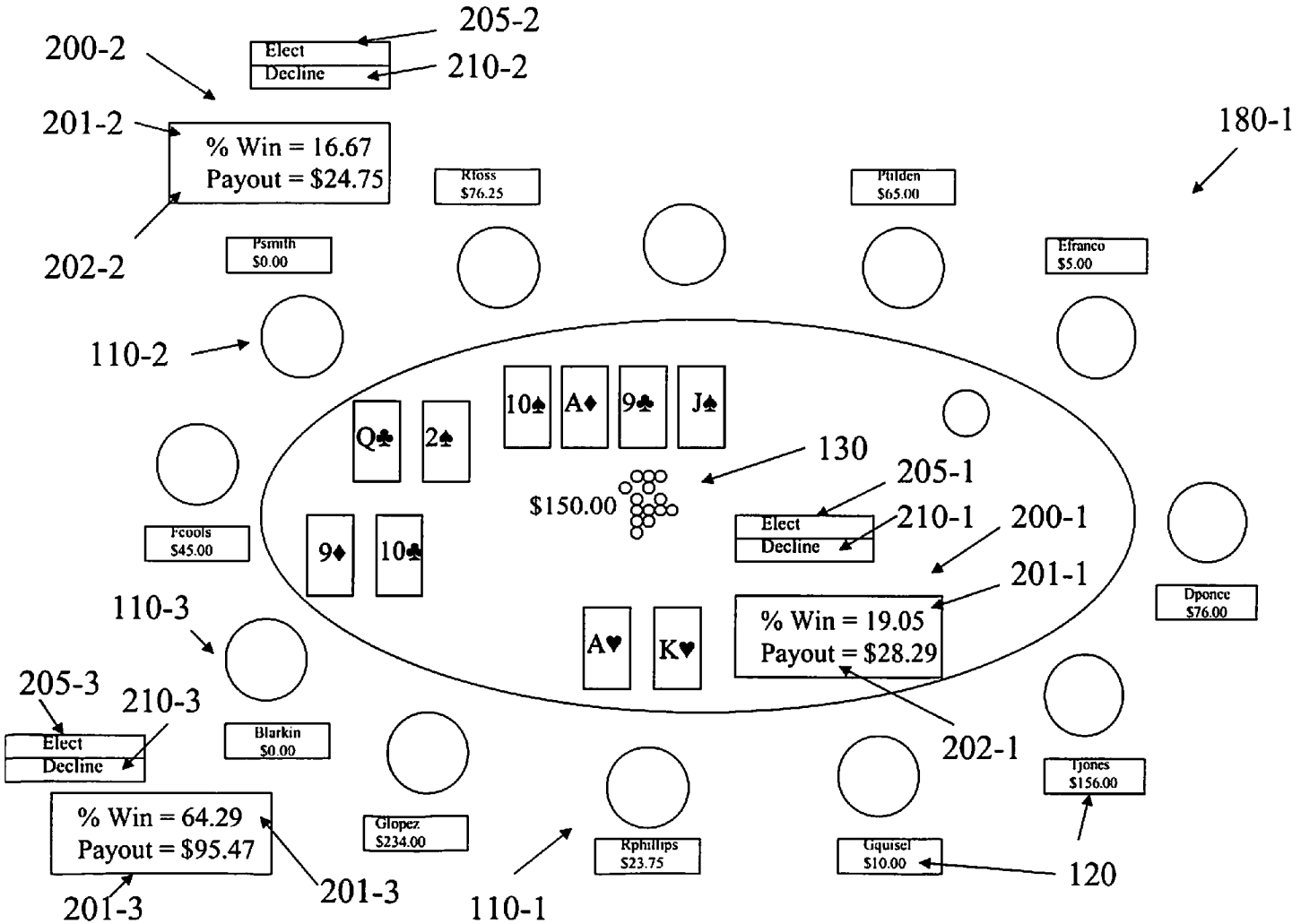
FIG. 3 illustrates an exemplary screen shot according to another embodiment of the present invention.

FIG. 3 shows a poker game with three remaining players 110-1 through 110-3 with two players 110-1, 110-2 all in such that no more betting is possible. As shown in FIG. 3, a pot allocation window 200-1 through 200-3 is presented to each player. As set forth above, each window 200-1 through 200-3 is only visible to the subject player on the player's display. The pot allocation windows 200-1 through 200-3 include, in this embodiment, the option to allocate the pot according to the true odds 201-1 through 201-3 associated with the respective hands and the amount 202-1 through 202-3 each player will receive if they accept the option. The amount 202-1 through 202-3 is the allocation according to the true odds 201-1 through 201-3 (i.e., the amount of the pot multiplied by the true odds) minus a percentage of the house fee paid to the house or operator for providing the pot allocation option. In a first embodiment, as shown in FIG. 3, the players pay an equal share (33%) of the house fee as taken from the pot.

Players may elect the option via box 205-1 through 205-3 or decline the option via box 210-1 through 210-3. As set forth above, the option may default as declined if either player does not make an election within a pre-determined amount of time (e.g., 3 seconds). If any player declines the option or the option defaults to decline for any player, the game proceeds in the normal manner with all remaining cards being displayed and the winning hand being awarded the pot. If all players decline the option or the option defaults to decline for all players, the game also proceeds in a normal manner with all remaining cards being displayed and the winner being awarded the pot. If all players accept the option, the pot is allocated as described above.

Figure 4:
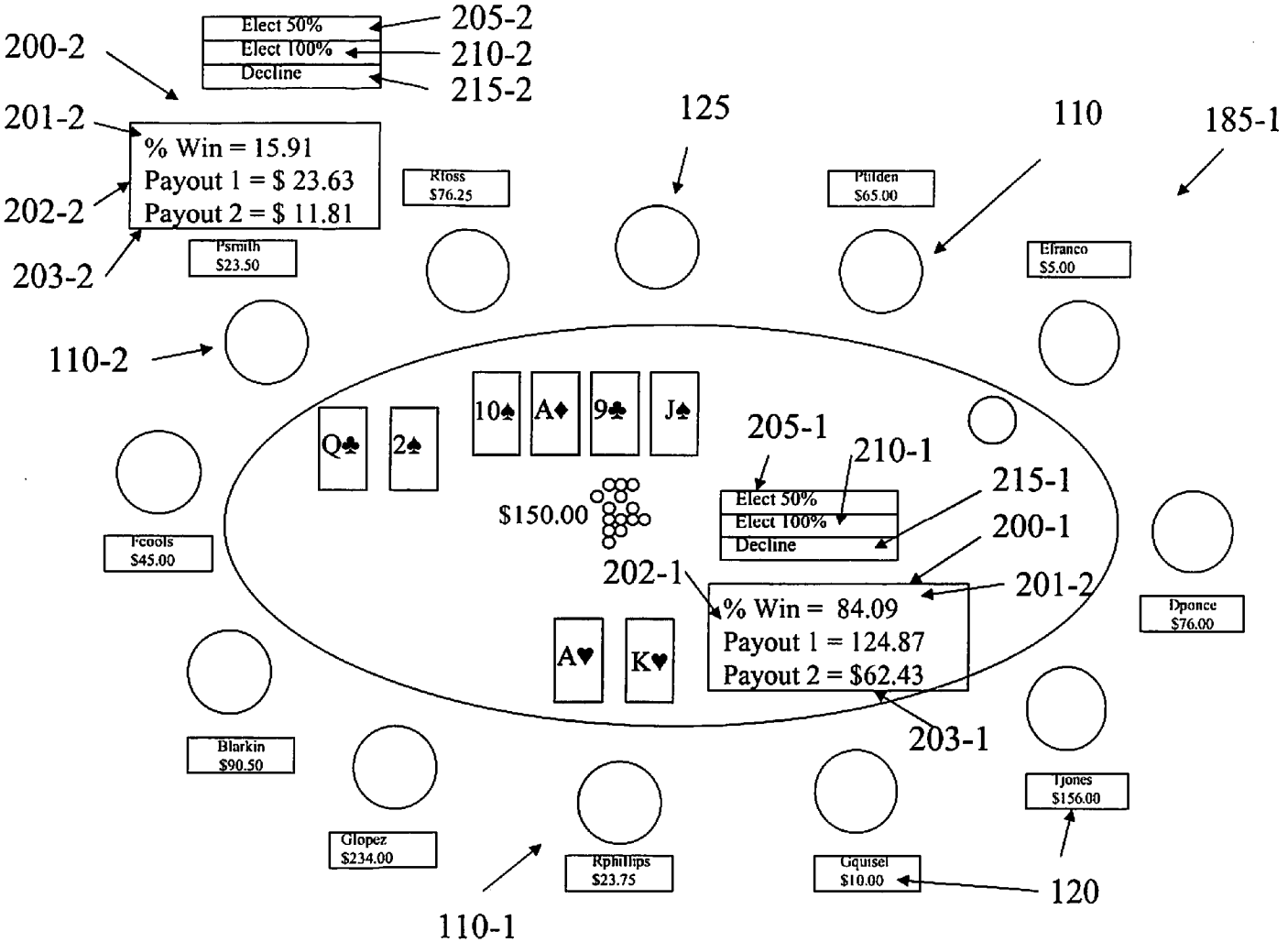
FIG. 4 illustrates an exemplary screen shot according to another embodiment of the present invention.

FIG. 4 shows a poker game with a heads-up situation between a first player 110-1 and second player 110-2 with the second player 110-2 all in. As shown in FIG. 4, when such a situation arises a pot allocation window 200-1, 200-2 is presented to each player. The pot allocation windows 200-1, 200-2 include, in this embodiment, three options for the players. A first option is to allocate the pot according to the true odds 201-1, 201-2 as described above. A second option is to allocate 50% of the pot according to the true odds 201-1, 201-2 and play out the hand for the remaining 50% of the pot. The third option is to decline both the first and second option. The pot allocation windows show two amounts associated with each of the first two options. A first amount 202-1, 202-2 is the true odds 201-1, 201-2 multiplied by the pot minus the house fee. The second amount 203-1, 203-2 is 50% of the true odds 201-1, 201-2 multiplied by the amount of the pot minus the house fee. In this instance, the house fee may be the same or reduced since it only relates to 50% of the pot.

Players may elect the first option via box 205-1, 205-2 and second option via box 210-1, 210-2 or decline both options via box 215-1, 215-2. Like above, the option may default as declined if either player does not make an election within a pre-determined amount of time (e.g., 3 seconds). If either player declines both options or a player option default to decline, the game proceeds in the normal manner with all remaining cards being displayed and the winning hand being awarded the pot. If both players decline the option or the option defaults to decline for both players, the game also proceeds in a normal manner with all remaining cards being displayed and the winner being awarded the pot. If both players accept the first option, the pot is allocated according to the true odds 201-1, 201-2. If both players accept the second option, 50% of the pot is allocated according to the true odds 201-1, 201-2 and the hand is played out for the remaining 50% of the pot. There are several possible outcomes if one player accepts the first option and one player accepts the second option. A first outcome is that 50% of the pot is allocated according to the true odds 201-1, 201-2 and the hand is played out for the remaining 50% of the pot because both players accepted some form of allocation. Alternatively, the pot may not be allocated at all and the hand played out because both players failed to agree.

Figure 6:
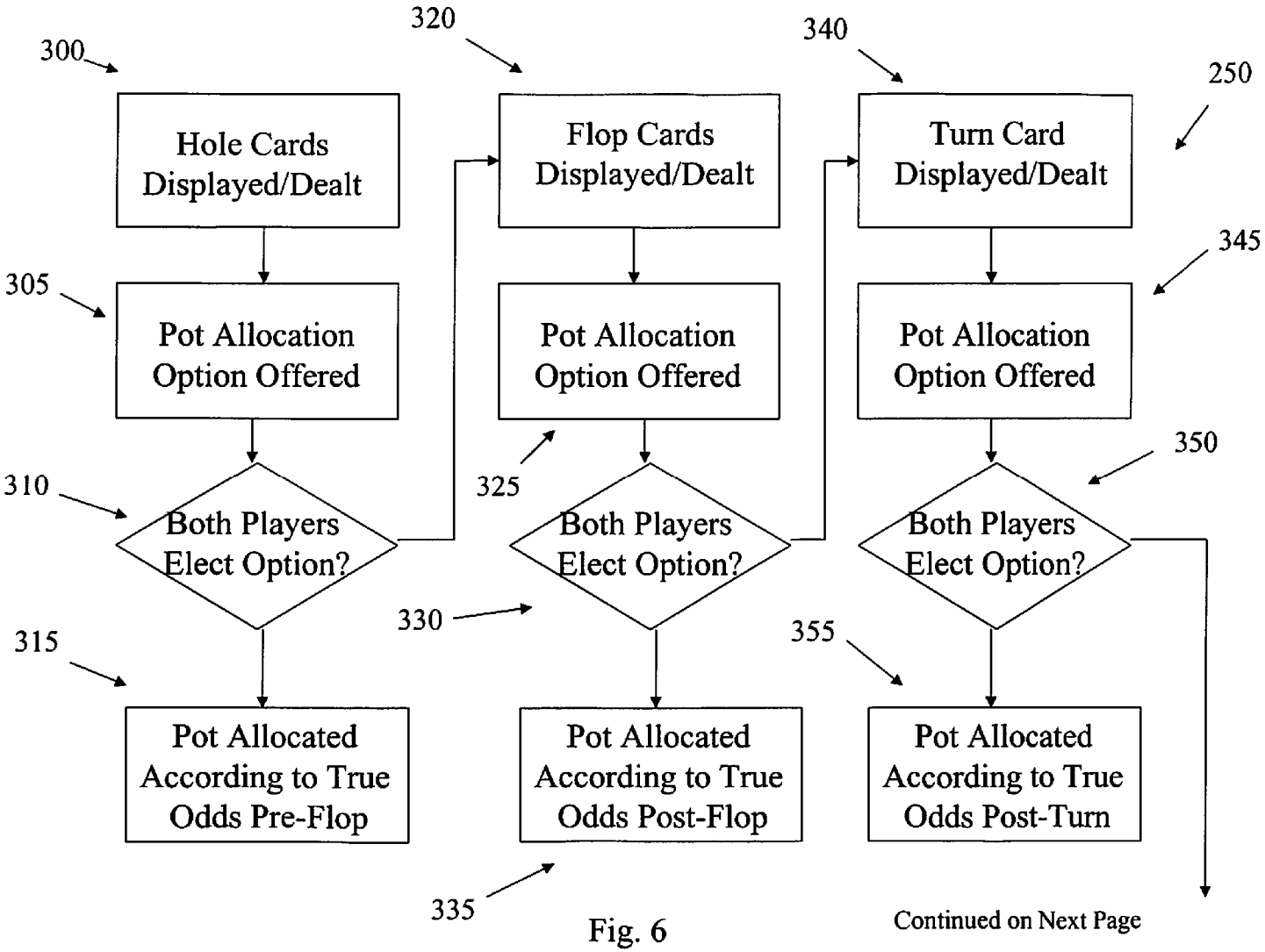
FIG. 6 illustrates a flow chart detailing another embodiment according to the embodiments of the present invention.

In another embodiment, as detailed in flow chart 250 of FIG. 6, the pot allocation option is offered to players at more than one game stage. Flow chart 250 presumes, at 300, two players are all in pre-flop (i.e., after the two hole cards are dealt)—more than two players may benefit from this embodiment as well. At 305, since both players are all in meaning no more betting is possible, the players are presented the pot allocation window according to the true odds at that point in time. At 310, it is determined if both players elect the pot allocation option pre-flop. If so, at 315, the pot is allocated according to the true odds pre-flop. If not, at 320, the flop cards are displayed/dealt. At 325, the pot allocation option is again offered to the players based on the new true odds (i.e., using the flop cards). At 330, it is determined if both players elect the pot allocation option post flop. If so, at 335, the pot is allocated according to the true odds post flop. If not, at 340, the turn card is displayed/dealt. At 345, the pot allocation option is again offered to the players based on the new true odds (i.e., using the flop and turn cards). At 350, it is determined if both players elect the pot allocation option post turn. If so, at 355, the pot is allocated according to the true odds post turn. If not, at 360, the river card is displayed/dealt and, at 365, the pot is awarded to the winner.

In another embodiment, the house or game operator may elect to purchase player hands when a player declines the option to allocate the pot. For example, if a first player has a 90% chance of winning the hand and accepts the pot allocation option but the second player having a 10% chance of winning the hand declines the pot allocation option, the house or operator can award the first player 90% of the pot and take the player's place and play out the hand against the second player. If the house wins, the house keeps the remaining 10% of the pot but if the house loses it must pay the second player the full pot amount (i.e., the other 90% awarded to the first player). The house or game operator is therefore seeking to play favorable odds in return for increased revenue beyond the pot allocation fee described above.

In another embodiment, players may be presented with multiple percentage options to allocate according to the true odds with the hand being played out for the remainder of the pot. For example, the players may be provided with the option to allocate 25%, 50% or 75% of the pot. If each player elects a percentage, the pot is allocated according to the smallest elected percentage with the hand being played out for the remainder of the pot. For example, in a heads-up situation, if one played elects 75% and the other selects 25%, 25% of the pot is allocated and the hand is played out for the remaining 75% of the pot. In another embodiment, players are allowed to enter any percentage in a range of percentages (25% to 75%). Again, the lowest elected percentage dictates the amount of the pot allocated.

The embodiments of the present invention are ideally suited for poker games facilitated by electronic devices (e.g., smart phone) and computer networks (e.g., the internet) which implement computer software to quickly calculate the true odds of players willing to utilize the pot allocation option and present players with a simple to use game interface to accept or decline the pot allocation option. The embodiments of the present invention, may also be used with electronic poker tables like the type sold by PokerTek, Inc., of North Carolina. Live poker games held in brick and mortar casinos and card rooms may also benefit from the embodiments of the present invention. To facilitate live brick and mortar games, charts or electronic systems which calculate true odds may be used to allocate pots. A live brick and mortar game may also use RFID game chips to track the amounts in the pot which can then be allocated according to the true odds determined by the chart or electronic system.

Although the invention has been described in detail with reference to several embodiments, additional variations and modifications exist within the scope and spirit of the invention.

We claim:

1. A method of conducting an electronic poker game comprising:

utilizing at least a processor for:

displaying on a display one or more hole cards to each of two or more players;

allowing via a user interface one or more betting rounds to occur and bets to be placed into a poker hand pot;

responsive to two or more players remaining in the poker hand and no more betting possible prior to an end of the poker hand, providing the remaining players with an option via said user interface to allocate the poker hand pot between said two or more players according to respective winning percentages of each remaining player winning the poker hand pot if the poker hand was played to a conclusion; and responsive to at least one remaining player declining the option to allocate the poker hand pot and one remaining player electing to allocate the poker hand pot, allowing a game operator the option to pay to the at least one remaining player electing the option to allocate the poker hand pot a percentage of the poker hand pot pursuant to a respective winning percentage and take the place of the at least one player electing the option to allocate the poker hand pot, and displaying on said display one or more remaining playing cards to complete the poker hand and paying either (i) the game operator the remaining percentage of the poker hand pot not allocated previously; or (ii) the at least one other player the poker hand pot prior to allocation.

2. A method of conducting an electronic poker game comprising:

utilizing at least a processor for:

displaying on a display one or more hole cards to each of two or more players;

allowing via a user interface one or more betting rounds to occur and bets to be placed into a poker hand pot;

responsive to two or more players remaining in the poker hand and no more betting possible prior to an end of the poker hand, providing the remaining players with an option to allocate the poker hand pot between said two or more players according to respective winning percentages of each remaining player winning the poker hand pot if the poker hand was played to a conclusion;

responsive to at least one remaining player declining the option to allocate the poker hand pot and one remaining player electing to allocate the poker hand pot, providing a game operator with the option to pay the at least one remaining player electing the option to allocate the poker hand pot a percentage of the poker hand pot pursuant to a respective winning percentage such that game operator takes the place of the at least one player electing the option to allocate the poker hand pot, and displaying one or more remaining playing cards to complete the poker hand and paying either (i) the game operator the remaining percentage of the poker hand pot not allocated previously; or (ii) the at least one other player the poker hand pot prior to allocation;

responsive to said game operator electing to not pay the at least one remaining player electing the option to allocate the poker hand pot the percentage of the poker hand pot pursuant to said respective winning percentage, displaying one or more remaining playing cards to complete the poker hand and paying the winning player the remaining percentage of the poker hand pot not allocated; and responsive to each of said remaining players accepting the option to allocate the poker hand pot, allocating the poker hand pot between said two or more players according to said respective winning percentages of each remaining player winning the poker hand pot if the poker hand was played to a conclusion.

3. A system comprising:

a central computer configured to communicate with a plurality of electronic devices, said central computer having at least one processor, said electronic devices having at least a display and user interface, wherein said central computer is configured to conduct an electronic poker game by:

displaying on displays of said plurality of electronic devices one or more hole cards to each of two or more players;

accepting bets via said user interfaces to form a poker hand pot;

responsive to two or more players remaining in the poker hand and no more betting possible prior to an end of the poker hand, providing the remaining players with an option via said user interface to allocate the poker hand pot between said two or more players according to respective winning percentages of each remaining player winning the poker hand pot if the poker hand was played to a conclusion; and responsive to at least one remaining player declining the option to allocate the poker hand pot and one remaining player electing to allocate the poker hand pot, allowing a game operator the option to pay to the at least one remaining player electing the option to allocate the poker hand pot a percentage of the poker hand pot pursuant to a respective winning percentage and take the place of the at least one player electing the option to allocate the poker hand pot, and displaying on said display one or more remaining playing cards to complete the poker hand and paying either (i) the game operator the remaining percentage of the poker hand pot not allocated previously; or (ii) the at least one other player the poker hand pot prior to allocation.

* * * * *